US009032624B2

(12) United States Patent
Yang

(10) Patent No.: US 9,032,624 B2
(45) Date of Patent: May 19, 2015

(54) PLATE-TYPE HEAT PIPE SEALING STRUCTURE AND MANUFACTURING METHOD THEREOF

(71) Applicant: Asia Vital Components Co., Ltd., Sinjhuang, Taipei County (TW)

(72) Inventor: Hsiu-Wei Yang, Sinjhuang (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 316 days.

(21) Appl. No.: 13/733,631

(22) Filed: Jan. 3, 2013

(65) Prior Publication Data

US 2013/0118011 A1 May 16, 2013

Related U.S. Application Data

(62) Division of application No. 12/897,329, filed on Oct. 4, 2010.

(51) Int. Cl.
*B23P 15/26* (2006.01)
*F28D 15/02* (2006.01)

(52) U.S. Cl.
CPC ..... *F28D 15/0283* (2013.01); *F28D 15/0233* (2013.01)

(58) Field of Classification Search
CPC ..... B23P 15/26; B23P 2700/09; F28D 15/02; F28D 15/0283; F28D 15/0233; F28D 15/0275; F28D 2015/0225
See application file for complete search history.

(56) References Cited

U.S. PATENT DOCUMENTS

| | | | | |
|---|---|---|---|---|
| 5,029,389 | A | 7/1991 | Tanzer | |
| 6,631,077 | B2 | 10/2003 | Zuo | |
| 6,782,942 | B1 | 8/2004 | Wang et al. | |
| 2007/0295486 | A1 | 12/2007 | Su et al. | |
| 2008/0185128 | A1 | 8/2008 | Moon et al. | |
| 2008/0245511 | A1 | 10/2008 | Lai | |
| 2009/0025910 | A1* | 1/2009 | Hoffman et al. | 165/104.26 |
| 2009/0178784 | A1* | 7/2009 | Wang | 165/104.26 |
| 2014/0182819 | A1* | 7/2014 | Yang | 165/104.26 |

* cited by examiner

*Primary Examiner* — Alexander P Taousakis

(57) ABSTRACT

A plate-type heat pipe sealing structure and a manufacturing method thereof are disclosed. The plate-type heat pipe includes a main body and a tube body. A notch is formed at one of two ends of the main body or one of four corners of the main body as a sealed section thereof. The tube body is disposed in the notch and connected with the main body. The main body of the plate-type heat pipe is cut by means of a mechanical processing method such as punching to form the notch. The notch of the main body is sealed by means of high frequency wave or copper welding. The tube body is positioned within the notch without protruding from the main body of the plate-type heat pipe. Accordingly, when assembled with a heat sink unit, the sealed section of the plate-type heat pipe will not interfere with the heat sink unit.

4 Claims, 7 Drawing Sheets

PLATE-TYPE HEAT PIPE SEALING STRUCTURE AND MANUFACTURING METHOD THEREOF

CROSS-REFERENCE TO RELATED APPLICATIONS

The present application is a division of U.S. patent application Ser. No. 12/897,329, filed Oct. 4, 2010, titled Plate-Type Heat Pipe Sealing Structure and Manufacturing Method Thereof listing Hsiu-Wei Yang as inventor.

FIELD OF THE INVENTION

The present invention relates to a plate-type heat pipe sealing structure and a manufacturing method thereof. The plate-type heat pipe includes a main body and a tube body. The main body of the plate-type heat pipe is formed with a notch in which the tube body is positioned without protruding from the main body of the plate-type heat pipe. Accordingly, when assembled with a heat sink unit, the tube body of the plate-type heat pipe will not interfere with the heat sink unit. In this case, the plate-type heat pipe can be more conveniently assembled with the heat sink unit.

BACKGROUND OF THE INVENTION

The plate-type heat pipe has the advantages of high heat conductivity, lightweight, simple structure, multiuse and easy processing. Moreover, the plate-type heat pipe is able to transfer heat at high efficiency without consuming any power. Therefore, the plate-type heat pipe is widely applied in various fields, especially applied to a heat-generating electronic component for quickly conducting the heat from the electronic component and avoiding heat accumulation.

A conventional plate-type heat pipe works on the principle that the plate-type heat pipe has an internal vacuumed chamber in which a working fluid is filled. When heated, the working fluid phase-changes into vapor to transfer heat. After cooled, the working fluid phase-changes into liquid phase and flows back to complete a cycle. An evaporation face of the plate-type heat pipe is attached to the surface of the heat-generating electronic component to partially absorb and dissipate the heat generated by the electronic component.

There is a trend to manufacture slimmer and slimmer electronic devices for easy carriage. To keep up with the trend, the plate-type heat pipe applied to the electronic component for dissipating the heat has become thinner and lighter. The conventional plate-type heat pipe has a closed end connected with a tube body. The closed end and the tube body protrude from a rectangular area of the main body of the plate-type heat pipe. Therefore, when assembling the plate-type heat pipe with a heat sink unit, the closed end and the tube body will interfere with the heat sink unit. This often leads to inconvenience in the assembling process or even breakage of the plate-type heat pipe. Therefore, the conventional plate-type heat pipe has the following shortcomings:

1. It is inconvenient to assemble the conventional plate-type heat pipe with the heat sink unit; and
2. When assembling the conventional plate-type heat pipe with the heat sink unit, the closed end and the tube body are likely to interfere with the heat sink unit.

SUMMARY OF THE INVENTION

A primary object of the present invention is to provide a plate-type heat pipe sealing structure capable of avoiding interference of the plate-type heat pipe with the heat sink unit in the assembling process.

A further object of the present invention is to provide a manufacturing method for a plate-type heat pipe sealing structure, which is capable of avoiding interference of the plate-type heat pipe with the heat sink unit in the assembling process.

To achieve the above and other objects, the plate-type heat pipe of the present invention includes a main body and a tube body. The main body has a first side, a second side, a third side, a fourth side and a notch. The first side intersects the third and fourth sides to define a first intersection section and a second intersection section. The second side intersects the third and fourth sides to define a third intersection section and a fourth intersection section.

The notch is selectively disposed on one of the first and second sides or one of the first, second, third and fourth intersection sections. The main body has an internal chamber. The tube body has a first end, which is a closed end, and a second end inserted in the notch and connected with the main body in communication with the chamber.

Still to achieve the above and other objects, the manufacturing method for the plate-type heat pipe sealing structure of the present invention includes steps of: providing a plate-type heat pipe having a main body; cutting the main body of the plate-type heat pipe to form a notch; and inserting a tube body into the notch and connecting the tube body with the main body and sealing the notch.

According to the plate-type heat pipe sealing structure of the present invention, the closed end of the main body and the tube body will not protrude from the rectangular area of the main body of the plate-type heat pipe. Therefore, when assembling the plate-type heat pipe with a heat sink unit, the closed end of the main body and the tube body will not interfere with the heat sink unit. This facilitates the assembling process of the plate-type heat pipe.

Accordingly, the present invention has the following advantages:

1. When assembling the plate-type heat pipe of the present invention with the heat sink unit, the closed end of the main body and the tube body will not interfere with the heat sink unit; and
2. It is convenient to assemble the plate-type heat pipe of the present invention with the heat sink unit.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
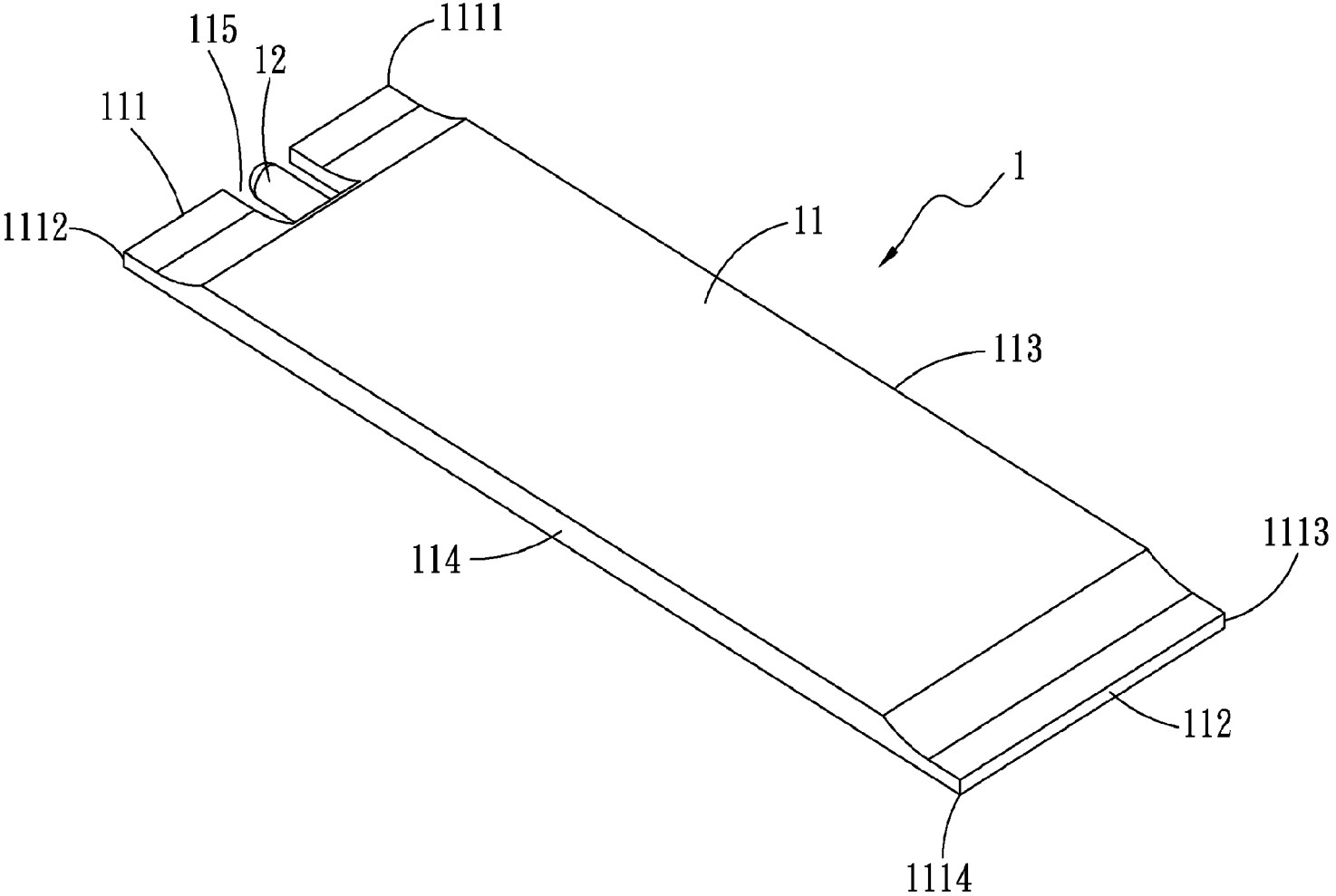
FIG. 1 is a perspective view of a first embodiment of the plate-type heat pipe of the present invention.

Please refer to FIGS. 1, 2, 3, 4 and 5. The plate-type heat pipe 1 of the present invention includes a main body 11 and a tube body 12.

The main body 11 has a first side 111, a second side 112, a third side 113, a fourth side 114 and a notch 115. The first and second sides 111, 112 are opposite to each other. Two ends of the first side 111 are respectively connected with the third and fourth sides 113, 114. Two ends of the second side 112 are respectively connected with the third and fourth sides 113, 114.

Figure 4:
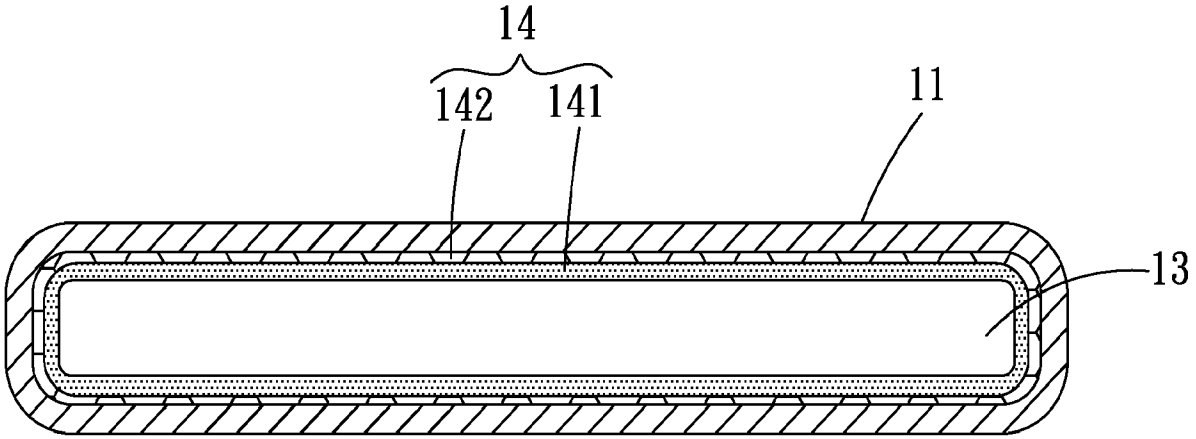
FIG. 4 is a sectional view of the plate-type heat pipe of the present invention in one aspect.

The first side 111 intersects the third and fourth sides 113, 114 to define a first intersection section 1111 and a second intersection section 1112. The second side 111 intersects the third and fourth sides 113, 114 to define a third intersection section 1113 and a fourth intersection section 1114. The notch 115 is selectively disposed on one of the first and second sides 111, 112 or one of the first, second, third and fourth intersection sections 1111, 1112, 1113, 1114. The main body 11 has an internal chamber 13 (as shown in FIG. 4).

Figure 2:
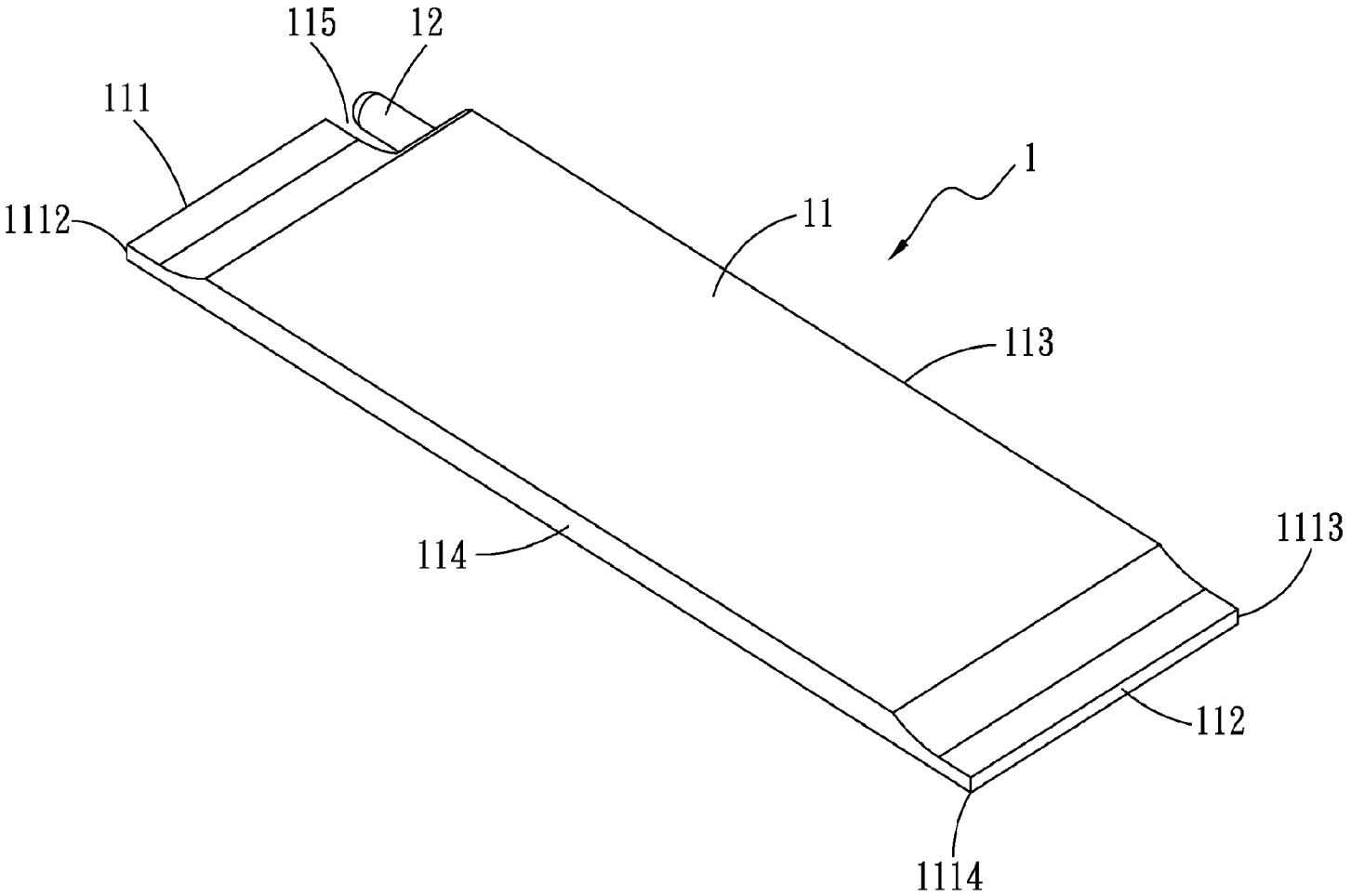
FIG. 2 is a perspective view of a second embodiment of the plate-type heat pipe of the present invention.
Figure 3:
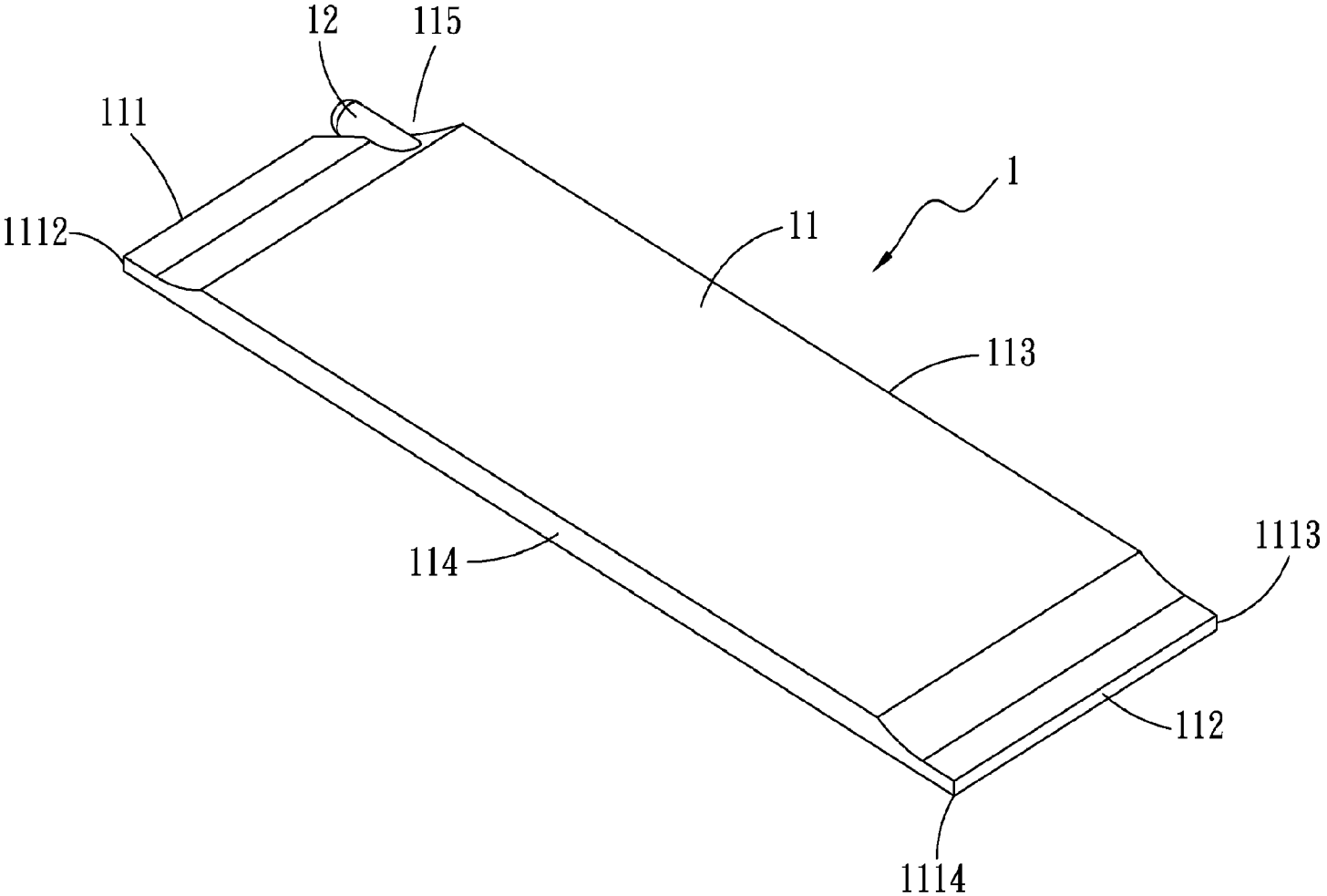
FIG. 3 is a perspective view of a third embodiment of the plate-type heat pipe of the present invention.

The notch 115 is in the form of a triangle or a rectangle. In the case that the notch 115 is disposed on the first side 111 or the second side 112, the notch 115 is rectangular (as shown in FIG. 1). In the case that the notch 115 is disposed on the first intersection section 1111, the second intersection section 1112, the third intersection section 1113 or the fourth intersection section 1114, the notch 115 is rectangular (as shown in FIG. 2) or triangular (as shown in FIG. 3).

The tube body 12 has a first end, which is a closed end, and a second end inserted in the notch 115 and connected with the main body 11 in communication with the chamber 13.

Figure 5:
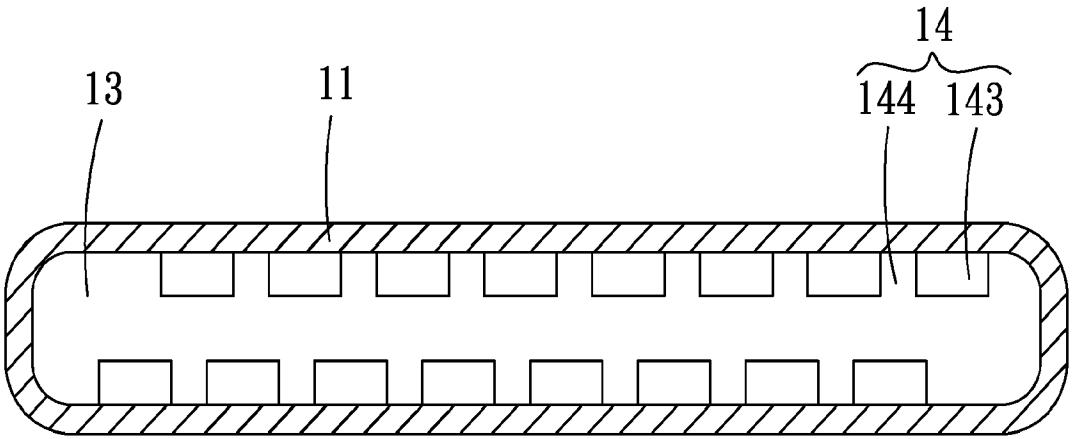
FIG. 5 is a sectional view of the plate-type heat pipe of the present invention in another aspect.
Figure 6:
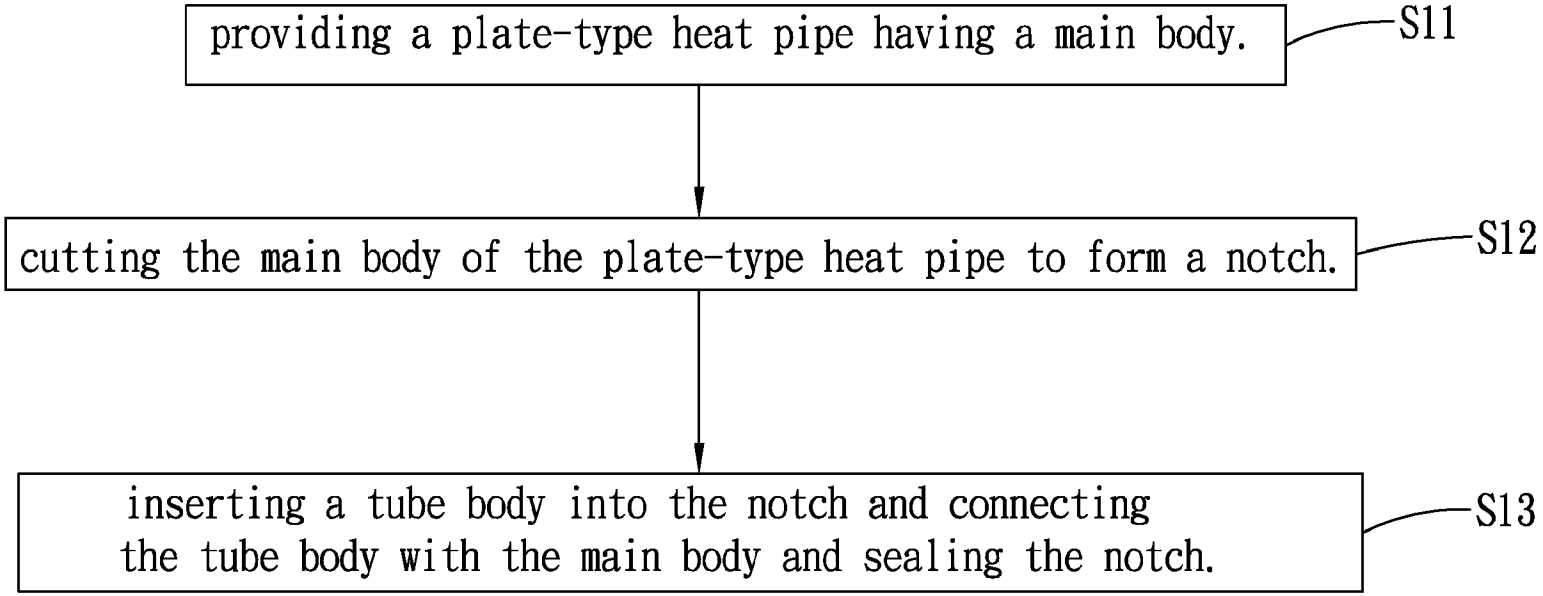
FIG. 6 is a flow chart of a first embodiment of the manufacturing method for the plate-type heat pipe sealing structure of the present invention.

A flow guide structure 14 is disposed in the chamber 13 and a working fluid is filled in the chamber 13. The flow guide structure 14 is a wick structure (as shown in FIG. 4) or a structure composed of multiple flow guide bodies 143 arranged at intervals to define at least one flow way 144 (as shown in FIG. 5). The wick structure includes a sintered body 141 and a mesh body 142.

Please refer to FIGS. 1, 2, 3, 4, 5 and 6. As shown in these figures, the method for manufacturing a plate-type heat pipe sealing structure according to the present invention includes steps as follows.

Step S11: providing a plate-type heat pipe having a main body.

In the step S11, a plate-type heat pipe 1 with an internal flow guide structure 14 is provided.

Step S12: cutting the main body of the plate-type heat pipe to form a notch.

In the step S12, the main body 11 of the plate-type heat pipe 1 is cut to form a notch 115 by means of a mechanical processing method such as punching, linear cutting and milling.

Step S13: inserting a tube body into the notch and connecting the tube body with the main body and sealing the notch.

In the step S13, a tube body 12 is inserted into the notch 115 and connected with the main body 11 and then the notch 115 is sealed by means of high frequency wave or copper welding.

Figure 7:
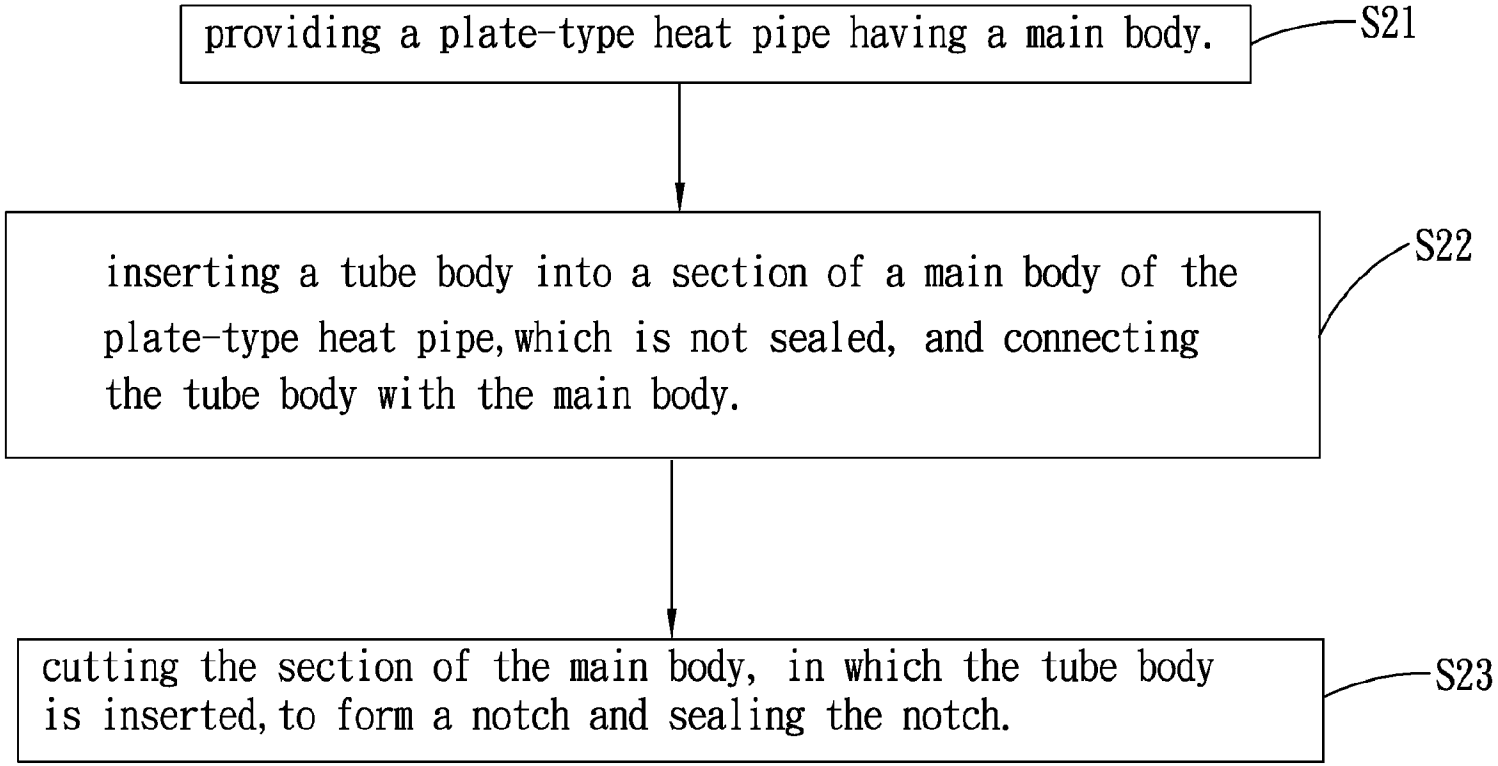
FIG. 7 is a flow chart of a second embodiment of the manufacturing method for the plate-type heat pipe sealing structure of the present invention.

Please refer to FIGS. 1, 2, 3, 4, 5 and 7. FIG. 7 is a flow chart of a second embodiment of the manufacturing method for the plate-type heat pipe sealing structure of the present invention. The manufacturing method includes steps as follows.

Step S21: providing a plate-type heat pipe having a main body.

In the step S21, a plate-type heat pipe 1 with an internal flow guide structure 14 is provided.

Step S22: inserting a tube body into a section of a main body of the plate-type heat pipe, which is not sealed, and connecting the tube body with the main body.

In the step S22, inserting a tube body 12 into a section of a main body 11 of the plate-type heat pipe 1, which is not yet sealed, and connecting the tube body 12 with the plate-type heat pipe 1.

Step S23: cutting the section of the main body, in which the tube body is inserted, to form a notch and sealing the notch.

In the step S23, cutting the section of the main body 11, in which the tube body 12 is inserted, to form a notch 115 by means of a mechanical processing method such as punching, linear cutting and milling and then sealing the notch 115 by means of high frequency wave or copper welding.

The above embodiments are only used to illustrate the present invention, not intended to limit the scope thereof. It is understood that many changes and modifications of the above embodiments can be made without departing from the spirit of the present invention. The scope of the present invention is limited only by the appended claims.

What is claimed is:

1. A manufacturing method for a plate-type heat pipe sealing structure, comprising steps of:

providing a plate-type heat pipe having a main body;

cutting the main body of the plate-type heat pipe to form a notch; and inserting a tube body into the notch and connecting the tube body with the main body and sealing the notch.

2. The manufacturing method for the plate-type heat pipe sealing structure as claimed in claim 1, wherein the tube body has a closed end.

3. The manufacturing method for the plate-type heat pipe sealing structure as claimed in claim 1, wherein the main body of the plate-type heat pipe is cut to form the notch by means of punching.

4. The manufacturing method for the plate-type heat pipe sealing structure as claimed in claim 1, wherein the notch of the main body is sealed by means of high frequency wave or copper welding.

* * * * *